US011192366B2

(12) United States Patent
Okui et al.

(10) Patent No.: US 11,192,366 B2
(45) Date of Patent: Dec. 7, 2021

(54) LIQUID EJECTING HEAD AND LIQUID EJECTING APPARATUS

(71) Applicant: SEIKO EPSON CORPORATION, Tokyo (JP)

(72) Inventors: Hiroaki Okui, Azumino (JP); Eiju Hirai, Azumino (JP); Toru Kashimura, Shiojiri (JP); Yuki Watanabe, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/934,684

(22) Filed: Jul. 21, 2020

(65) Prior Publication Data

US 2021/0023844 A1 Jan. 28, 2021

(30) Foreign Application Priority Data

Jul. 22, 2019 (JP) ..... JP2019-134826

(51) Int. Cl.

*B41J 2/14* (2006.01)
*B41J 2/155* (2006.01)
*B41J 2/045* (2006.01)

(52) U.S. Cl.

CPC ..... *B41J 2/14201* (2013.01); *B41J 2/04581* (2013.01); *B41J 2/155* (2013.01); *B41J 2002/14491* (2013.01); *B41J 2202/21* (2013.01)

(58) Field of Classification Search

CPC .... B41J 2/14201; B41J 2/155; B41J 2/04581; B41J 2202/21; B41J 2002/14491; B41J 2/04541; B41J 2002/14419; B41J 2002/14362; B41J 2/14233; B41J 2/01; B41J 2/07

See application file for complete search history.

(56) References Cited

U.S. PATENT DOCUMENTS

2004/0001122 A1 1/2004 Miyata
2018/0297357 A1* 10/2018 Menzel ..... B41J 2/1631

FOREIGN PATENT DOCUMENTS

JP 2004-034293 2/2004

OTHER PUBLICATIONS

IP.com search (Year: 2021).*
IP.com2 search (Year: 2021).*

* cited by examiner

*Primary Examiner* — Lisa Solomon
(74) *Attorney, Agent, or Firm* — Workman Nydegger

(57) ABSTRACT

A length of a path between the input section and the third energy generation element in the wiring section is shorter than a length of a path between the input section and the first energy generation element in the wiring section and shorter than a length of a path between the input section and the second energy generation element in the wiring section.

11 Claims, 13 Drawing Sheets

LIQUID EJECTING HEAD AND LIQUID EJECTING APPARATUS

The present application is based on, and claims priority from JP Application Serial Number 2019-134826, filed Jul. 22, 2019, the disclosure of which is hereby incorporated by reference herein in its entirety.

BACKGROUND

1. Technical Field

The present disclosure relates to a liquid ejecting head and a liquid ejecting apparatus.

2. Related Art

A liquid ejecting head that ejects a liquid such as ink from multiple nozzles has been proposed. For example, JP-A-2004-34293 discloses a configuration for supplying a signal to eject a liquid to a driving IC via a wiring pattern from external wiring.

For example, wiring for supplying a signal to eject a liquid is formed in a straight line and extends in a direction in which multiple piezoelectric elements are arrayed. Therefore, a voltage drop caused by a resistance component of the wiring is a problem.

SUMMARY

According to an aspect of the present disclosure, a liquid ejecting head ejects a liquid and includes an input section to which a signal is input, a nozzle string in which a plurality of nozzles that include a first nozzle, a second nozzle located closer to the input section than the first nozzle, and a third nozzle located between the first nozzle and the second nozzle and eject the liquid are arrayed in a predetermined direction, a first energy generation element corresponding to the first nozzle, a second energy generation element corresponding to the second nozzle, a third energy generation element corresponding to the third nozzle, and a wiring section coupling the input section, the first energy generation element, the second energy generation element, and the third energy generation element. A length of a path between the input section and the third energy generation element in the wiring section is shorter than a length of a path between the input section and the first energy generation element in the wiring section and shorter than a length of a path between the input section and the second energy generation element in the wiring section.

According to another aspect of the present disclosure, a liquid ejecting apparatus configured to eject a liquid includes a liquid ejecting head and a controller. The liquid ejecting head ejects the liquid and includes an input section to which a signal is input, a nozzle string in which a plurality of nozzles that include a first nozzle, a second nozzle located closer to the input section than the first nozzle, and a third nozzle located between the first nozzle and the second nozzle and eject the liquid are arrayed in a predetermined direction, a first energy generation element corresponding to the first nozzle, a second energy generation element corresponding to the second nozzle, a third energy generation element corresponding to the third nozzle, and a wiring section coupling the input section, the first energy generation element, the second energy generation element, and the third energy generation element. The controller controls the ejection of the liquid. A length of a path between the input section and the third energy generation element in the wiring section is shorter than a length of a path between the input section and the first energy generation element in the wiring section and shorter than a length of a path between the input section and the second energy generation element in the wiring section.

DESCRIPTION OF EXEMPLARY EMBODIMENTS

A. First Embodiment

Figure 1:
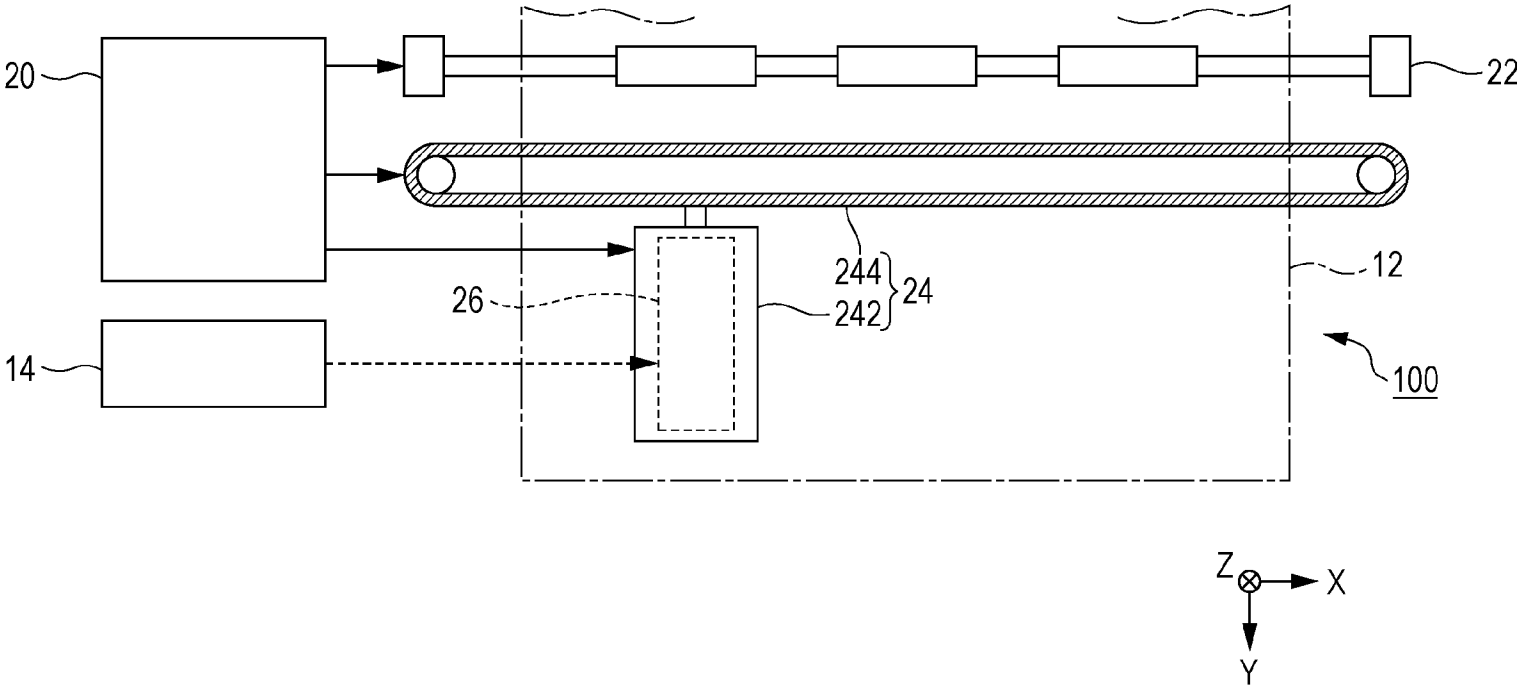
FIG. 1 is a block diagram illustrating a configuration of a liquid ejecting apparatus according to a first embodiment of the present disclosure.

FIG. 1 is a configuration diagram exemplifying a liquid ejecting apparatus 100 according to a first embodiment of the present disclosure. The liquid ejecting apparatus 100 according to the first embodiment is an ink jet printing apparatus for ejecting ink onto a medium 12. The ink is an example of a liquid. The medium 12 is typically a printing sheet, but a printing object made of an arbitrary material such as a resin film or cloth may be used as the medium 12. As exemplified in FIG. 1, a liquid container 14 for storing ink is installed in the liquid ejecting apparatus 100. For example, a cartridge attachable to and detachable from the liquid ejecting apparatus 100, a bag-shaped ink pack made of a flexible film, or an ink tank able to be filled with ink is used as the liquid container 14. Multiple types of ink of different colors are stored in the liquid container 14.

As exemplified in FIG. 1, the liquid ejecting apparatus 100 includes a control unit 20, a transporting mechanism 22, a moving mechanism 24, and a liquid ejecting head 26. The control unit 20 is an example of a controller. Specifically, the control unit 20 includes one or multiple processing circuits such as central processing units (CPUs) or field programmable gate arrays (FPGAs) and one or multiple storage circuits such as semiconductor memories and comprehensively controls the elements of the liquid ejecting apparatus 100. The transporting mechanism 22 transports the medium 12 in a Y axis direction under control by the control unit 20.

The moving mechanism 24 causes the liquid ejecting head 26 to reciprocate in an X axis direction under control by the control unit 20. The X axis direction intersects the Y axis direction in which the medium 12 is transported. Typically, the X axis direction is perpendicular to the Y axis direction. The moving mechanism 24 according to the first embodiment includes a substantially box-shaped transport body 242 for storing the liquid ejecting head 26, and a transport belt 244 to which the transport body 242 is fixed. A configuration in which multiple liquid ejecting heads 26 are installed in the transport body 242 or a configuration in which the liquid container 14 and the liquid ejecting head 26 are installed in the transport body 242 may be used.

The liquid ejecting head 26 ejects the ink supplied from the liquid container 14 onto the medium 12 from multiple nozzles under control by the control unit 20. In this case, the liquid ejecting head 26 ejects the ink onto the medium 12 in parallel with the transport of the medium 12 by the transporting mechanism 22 and the repetitive reciprocation of the transport body 242 so that a desired image is formed on a surface of the medium 12. A direction perpendicular to an X-Y plane is hereinafter referred to as a Z axis direction. A direction in which the ink is ejected by the liquid ejecting head 26 corresponds to the Z axis direction. The Z axis direction is typically a vertical direction.

Figure 2:
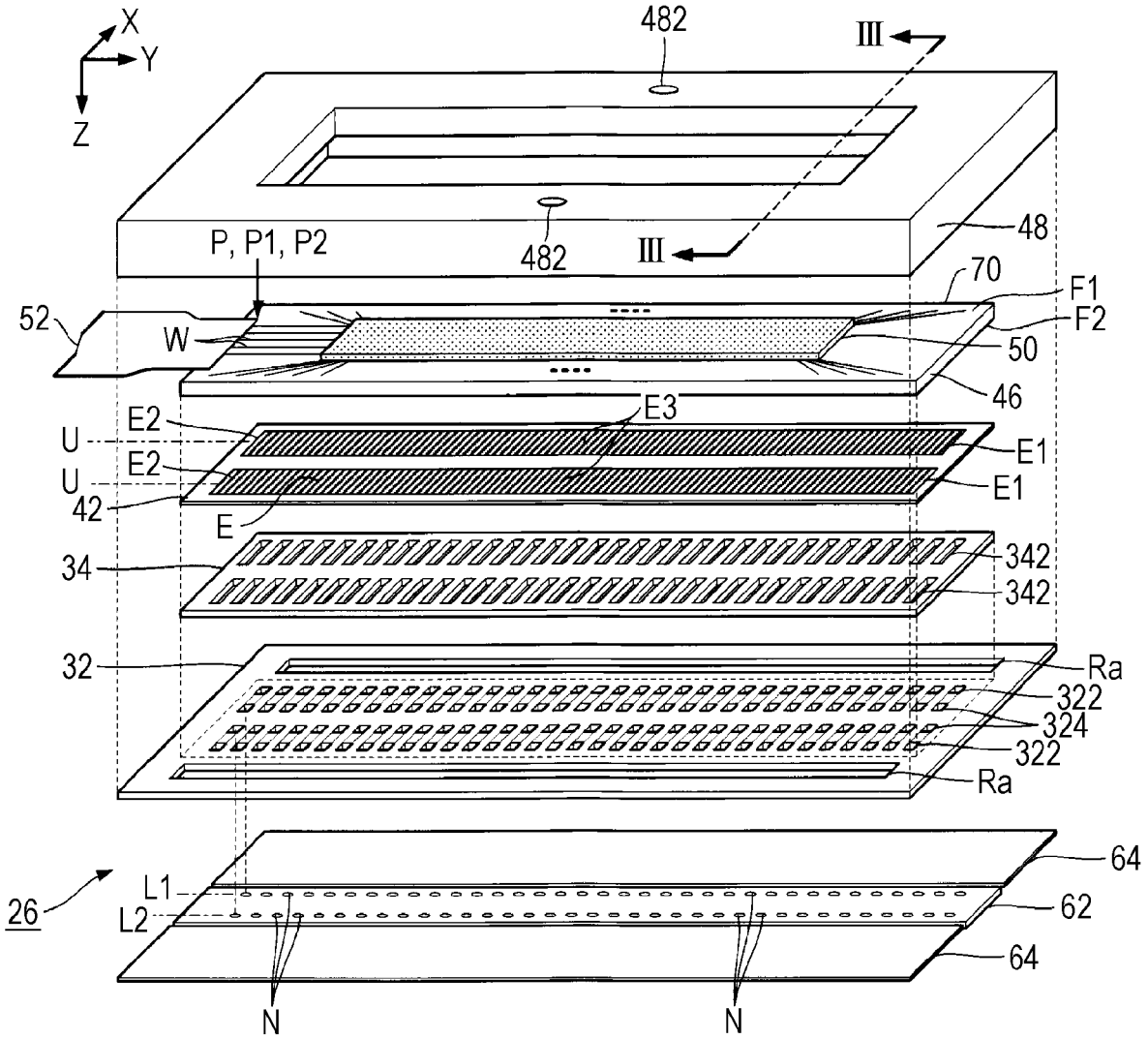
FIG. 2 is an exploded perspective view of a liquid ejecting head.

FIG. 2 is an exploded perspective view of the liquid ejecting head 26. FIG. 2 is a cross-sectional view taken along a line III-III illustrated in FIG. 3. As exemplified in FIG. 2, the liquid ejecting head 26 includes multiple nozzles N arrayed in the Y axis direction. The nozzles N according to the first embodiment are classified into a first string L1 and a second string L2 that are arranged at a distance in the X axis direction. In the following description, when the first string L1 and the second string L2 do not need to be distinguished, the first string L1 and the second string L2 are referred to as "nozzle strings L". Each of the nozzle strings L is a set of multiple nozzles N arrayed in a straight line in the Y axis direction. The Y axis direction in which the nozzles N are arrayed is an example of a "predetermined direction". The positions of nozzles N of the first string L1 in the Y axis direction can be different from the positions of nozzles N of the second string L2 in the Y axis direction. However, a configuration in which the positions of the nozzles N of the first string L1 in the Y axis direction match the positions of the nozzles N of the second string L2 in the Y axis direction is exemplified below for convenience. As understood from FIG. 3, the liquid ejecting head 26 according to the first embodiment has a structure in which elements related to the nozzles N of the first string L1 are substantially plane-symmetric with respect to elements related to the nozzles N of the second string L2.

Figure 3:
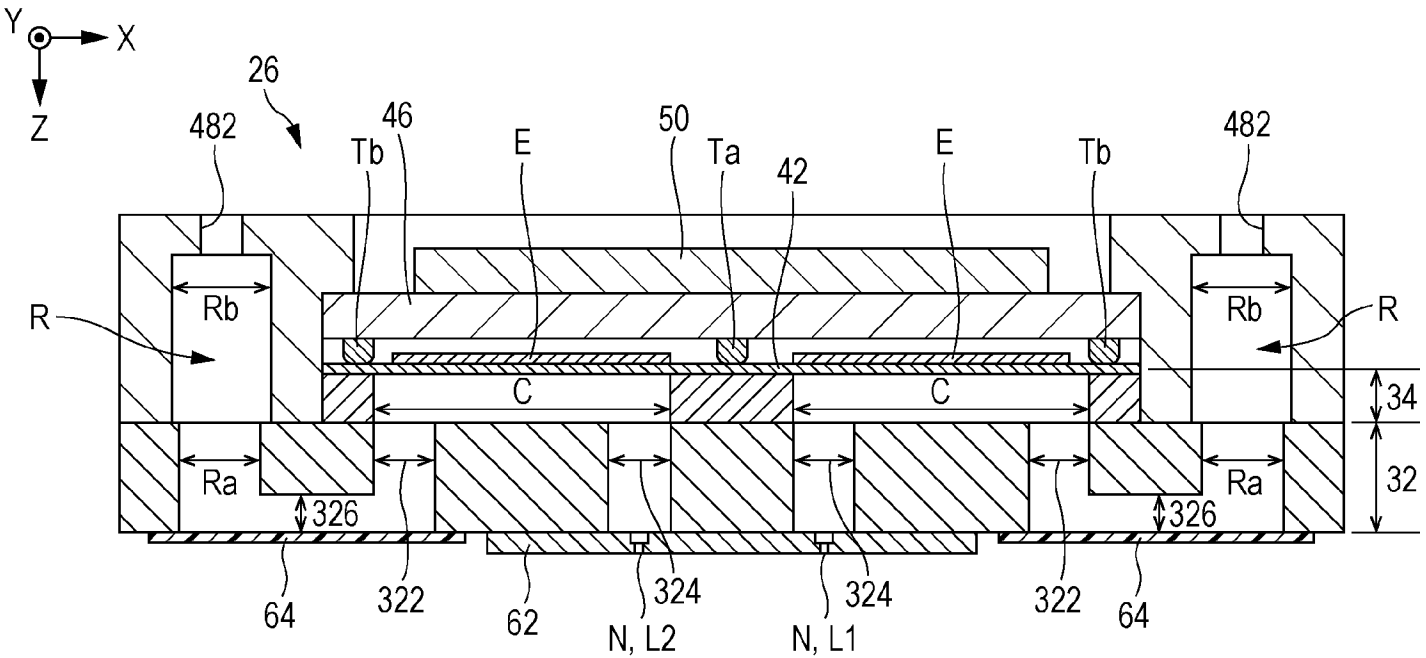
FIG. 3 is a cross-sectional view (taken along a line III-III illustrated in FIG. 2) of the liquid ejecting head.

As exemplified in FIGS. 2 and 3, the liquid ejecting head 26 includes a channel substrate 32. As exemplified in FIG. 2, a pressure chamber substrate 34, a vibrating plate 42, a wiring substrate 46, a casing 48, and a driving circuit 50 are mounted on a negative side with respect to the channel substrate 32 in the Z axis direction. A nozzle plate 62 and vibration dampers 64 are mounted on a positive side with respect to the channel substrate 32 in the Z axis direction. The elements of the liquid ejecting head 26 are substantially plate-shaped long members extending in the Y axis direction and are bonded to each other via, for example, an adhesive.

The nozzle plate 62 is a plate-shaped member having the nozzles N formed therein and is mounted on a surface of the channel substrate 32 on the positive side in the Z axis direction. Each of the nozzles N is a circular through-hole through which the ink passes. The nozzles N constituting the nozzle strings L are formed in the nozzle plate 62 according to the first embodiment. For example, the nozzle plate 62 is formed by processing a silicon monocrystalline substrate using a semiconductor manufacturing technique such as dry etching or wet etching. However, a known material and a known formation method may be arbitrarily used to form the nozzle plate 62.

As exemplified in FIGS. 2 and 3, a space Ra, multiple supply channels 322, multiple communication channels 324, and a supply liquid chamber 326 are formed in the channel substrate 32 for each of the first and second strings L1 and L2. Each of the spaces Ra is an opening extending in the Y axis direction and formed in a long shape in a plan view from the Z axis direction. The supply channels 322 and the communication channels 324 are through-holes. Each of the supply channels 322 is formed for a respective one of the nozzles N, and each of the communication channels 324 is formed for a respective one of the nozzles N. The supply liquid chambers 326 are spaces formed in long shapes and extending across the nozzles N in the Y axis direction. The supply liquid chambers 326 are formed so that the spaces Ra communicate with the supply channels 322. Each of the communication channels 324 overlaps a respective one of the nozzles N that corresponds to the communication channel 324.

As exemplified in FIGS. 2 and 3, the pressure chamber substrate 34 is a plate-shaped member having multiple pressure chambers C formed therein for each of the nozzle strings L. The pressure chambers C are arrayed in the Y axis direction. Each of the pressure chambers C is a space formed in a long shape for a respective one of the nozzles N and extending in the Y axis direction in a plan view. The channel substrate 32 and the pressure chamber substrate 34 are formed by, for example, processing a silicon monocrystalline substrate using the semiconductor manufacturing technique, like the foregoing nozzle substrate 62. However, a known material and a known formation method may be arbitrarily used to form the channel substrate 32 and the pressure chamber substrate 34.

As exemplified in FIG. 2, the vibrating plate 42 is formed on a surface of the pressure chamber substrate 34 on the opposite side to the channel substrate 32. The vibrating plate 42 according to the first embodiment is a plate-shaped member that can elastically vibrate. A portion of the vibrating plate 42 or the entire vibrating plate 42 may be integrated with the pressure chamber substrate 34 by selectively removing portions of the plate-shaped member with a predetermined thickness. In this case, the portions of the plate-shaped member are regions corresponding to the pressure chambers C in a thickness direction of the plate-shaped member.

Figure 4:
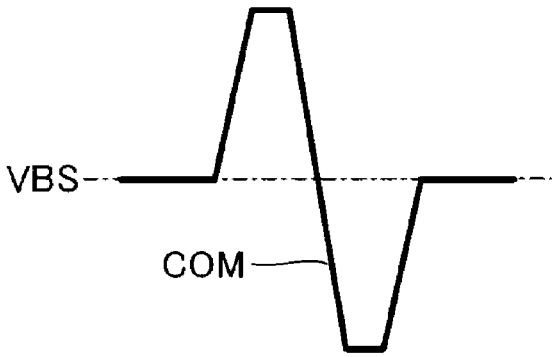
FIG. 4 is a waveform diagram of a driving signal.

As understood from FIG. 2, the pressure chambers C are spaces between the channel substrate 32 and the vibrating plate 42. The pressure chambers C are arrayed in the Y axis direction for each of the nozzle strings L. As exemplified in FIGS. 4 and 5, the pressure chambers C communicate with the communication channels 324 and the supply channels 322. Therefore, the pressure chambers C communicate with the nozzles N through the communication channels 324 and communicate with the spaces Ra through the supply channels 322 and the supply liquid chambers 326.

As exemplified in FIGS. 2 and 3, multiple energy generation elements E corresponding to the different nozzles N are formed on a surface of the vibrating plate 42 on the opposite side to the pressure chambers C for each of the nozzle strings L. The energy generation elements E are driving elements for ejecting the ink from the nozzles N by changing pressure in the pressure chambers C. For example, piezoelectric elements for changing volumes of the pressure chambers C by transforming wall surfaces of the pressure chambers C are used as the energy generation elements E.

Specifically, the energy generation elements E are actuators that are transformed by the supply of a driving signal COM. Each of the energy generation elements E is formed in a long shape and extends in the X axis direction in a plan view. As exemplified in FIG. 4, the driving signal COM is a voltage signal including, for each of predetermined cycles, a driving pulse fluctuating based on a reference voltage VBS indicated by a hold signal S. A driving signal with a waveform including multiple driving pulses may be used as the driving signal COM. The energy generation elements E are arrayed in the Y axis direction so that the energy generation elements E correspond to the pressure chambers C. Specifically, each of arrays U of the energy generation elements E is formed for a respective one of the nozzle strings L. It can be said that the Y axis direction is a direction in which the energy generation elements E are arrayed. When the vibrating plate 42 vibrates in coordination with the transformation of the energy generation elements E, the pressure in the pressure chambers C changes and the ink with which the pressure chambers C are filled passes through the communication channels 324 and the nozzles N and is ejected from the nozzles N.

Figure 5:
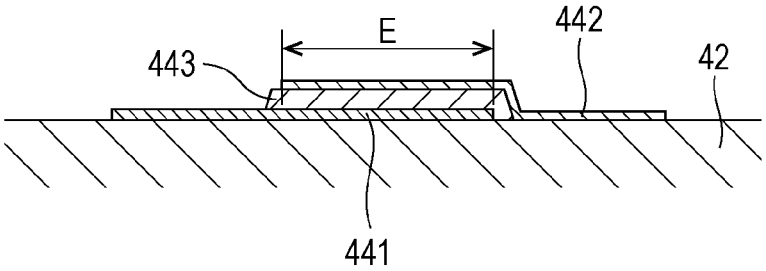
FIG. 5 is a cross-sectional view illustrating a configuration of each of energy generation elements.

FIG. 5 is a cross-sectional view of each of the energy generation elements E. As exemplified in FIG. 5, each of the energy generation elements E is a stacked body in which a piezoelectric layer 443 exists between a first electrode 441 and a second electrode 442 arranged opposite to the first electrode 441. Each of the first electrodes 441 is an individual electrode formed on the surface of the vibrating plate 42 for a respective one of the energy generation elements E. The driving signal COM is supplied to each of the first electrodes 441 of the energy generation elements E. The piezoelectric layer 443 is formed of, for example, a ferroelectric piezoelectric material such as a lead zirconate titanate. The second electrode 442 is a common electrode continuous across the energy generation elements E. The common hold signal S is supplied to the second electrode 442 continuous across the energy generation elements E. In other words, a reference voltage VBS is applied to the second electrode 442. Specifically, a voltage corresponding to a difference between the reference voltage VBS and the driving signal COM is applied to the piezoelectric layer 443. A portion where the first electrode 441, the second electrode 442, and the piezoelectric layer 443 overlap each other in a plan view functions as the energy generation element E. When the vibrating plate 42 vibrates in coordination with the transformation of the energy generation elements E, the pressure of the ink within the pressure chambers C changes and the ink with which the pressure chambers C are filled passes through the communication channels 324 and the nozzles N and is ejected to the outside. The energy generation elements E are displaced based on a voltage applied to the piezoelectric layers 443. As understood from the above description, it can be said that the driving signal COM is a signal to give different amounts of energy to the energy generation elements E based on amounts of the ink to be ejected from the nozzles N. In addition, it can be said that the hold signal S is a signal to give a constant amount of energy to the energy generation elements E regardless of the amounts of the ink to be ejected from the nozzles N. The reference voltage VBS may be a ground voltage. Furthermore, a configuration in which a first electrode 441 serves as a common electrode and second electrodes 442 serve as individual electrodes of the energy generation elements E, or a configuration in which the first electrodes 441 and the second electrodes 442 serve as individual electrodes may be used.

The casing 48 is configured to store the ink to be supplied to the pressure chambers C. As exemplified in FIG. 3, each of spaces Rb is formed in the casing 48 according to the first embodiment for a respective one of the nozzle strings L. The spaces Rb of the casing 48 communicate with the spaces Ra of the channel substrate 32. Spaces constituted by the spaces Ra and the spaces Rb function as liquid reservoirs R for storing the ink to be supplied to the pressure chambers C. The ink is supplied to the liquid reservoirs R through inlets 482 formed in the casing 48. The ink within the liquid reservoirs R is supplied to the pressure chambers C through the supply liquid chambers 326 and the supply channels 322. The vibration dampers 64 are flexible films constituting wall surfaces of the liquid reservoirs R and reduce changes in the pressure of the ink within the liquid reservoirs R.

The wiring substrate 46 illustrated in FIG. 2 is a plate-shaped member arranged opposite to the surface of the vibrating plate 42 at a distance, and the energy generation elements E are formed on the surface of the vibrating plate 42. The wiring substrate 46 according to the first embodiment functions as a reinforcing plate for reinforcing mechanical strength of the liquid ejecting head 26 and a sealing plate for protecting and sealing the energy generation elements E. The wiring substrate 46 is electrically coupled to the control unit 20 via external wiring 52. The external wiring 52 is a flexible wiring substrate for supplying various voltages and signals generated by the control unit 20 from the control unit 20 to the wiring substrate 46. For example, a flexible printed circuit (FPC) or a coupling component such as a flexible flat cable is preferably used as the external wiring 52.

The casing 48 is configured to store the ink to be supplied to the pressure chambers C (and to be supplied to the nozzles N). As exemplified in FIG. 3, each of the spaces Rb is formed in the casing 48 according to the first embodiment for a respective one of the nozzle strings L. The spaces Rb of the casing 48 communicate with the spaces Ra of the channel substrate 32. The spaces constituted by the spaces Ra and Rb function as the liquid reservoirs (reservoirs) R for storing the ink to be supplied to the pressure chambers C. The ink is supplied to the liquid reservoirs R through the inlets 482 formed in the casing 48. The ink within the liquid reservoirs 48 is supplied to the pressure chambers C through the supply liquid chambers 326 and the supply channels 322. The vibration dampers 64 are flexible films (compliance substrates) constituting the wall surfaces of the liquid reservoirs R and reduce changes in the pressure of the ink within the liquid reservoirs R.

The wiring substrate 46 includes a base 70 and multiple wiring sections W. The base 70 is a plate-shaped long insulating member extending in the Y axis direction and is located between a channel forming section 30 and the driving circuit 50. The base 70 is formed by, for example, processing a silicon monocrystalline substrate using the semiconductor manufacturing technique. However, a known material and a known formation method may be arbitrarily used to form the base 70.

As exemplified in FIG. 2, the base 70 is the plate-shaped member including a first surface F1 and a second surface F2 arranged opposite to the first surface F1. The base 70 is fixed to the surface of the pressure chamber substrate 34 (or the vibrating plate 42) via, for example, an adhesive on the opposite side to the channel substrate 32. Specifically, the base 70 is mounted so that the second surface F2 is arranged opposite to the surface of the vibrating plate 42 at a distance. As exemplified in FIG. 2, the driving circuit 50 and the external wiring 52 are mounted on the first surface F1 of the base 70. The driving circuit 50 is a long IC chip extending in a longitudinal direction of the base 70. The external wiring 52 is mounted at an end of the first surface F1 of the base 70 on a negative side in the Y axis direction. As exemplified in FIG. 2, the base 70 and the various wiring sections W for driving the energy generation elements E are formed. The wiring sections W are coupled to the external wiring 52. In fact, the wiring sections W are formed so that the wiring sections W are electrically coupled to the energy generation elements E from the surface of the base 70.

A coupling terminal Ta and coupling terminals Tb are formed on a surface of the wiring substrate 46 on the vibrating plate 42 side. The coupling terminal Ta couples the wiring substrate 46 to the second electrode 442 extending across the energy generation elements E and is used to supply the hold signal S to the second electrode 442. The coupling terminals Tb individually couple the driving circuit 50 to the first electrodes 441 of the energy generation elements E and are used to supply the driving signal COM to the first electrodes 441.

Figure 6:
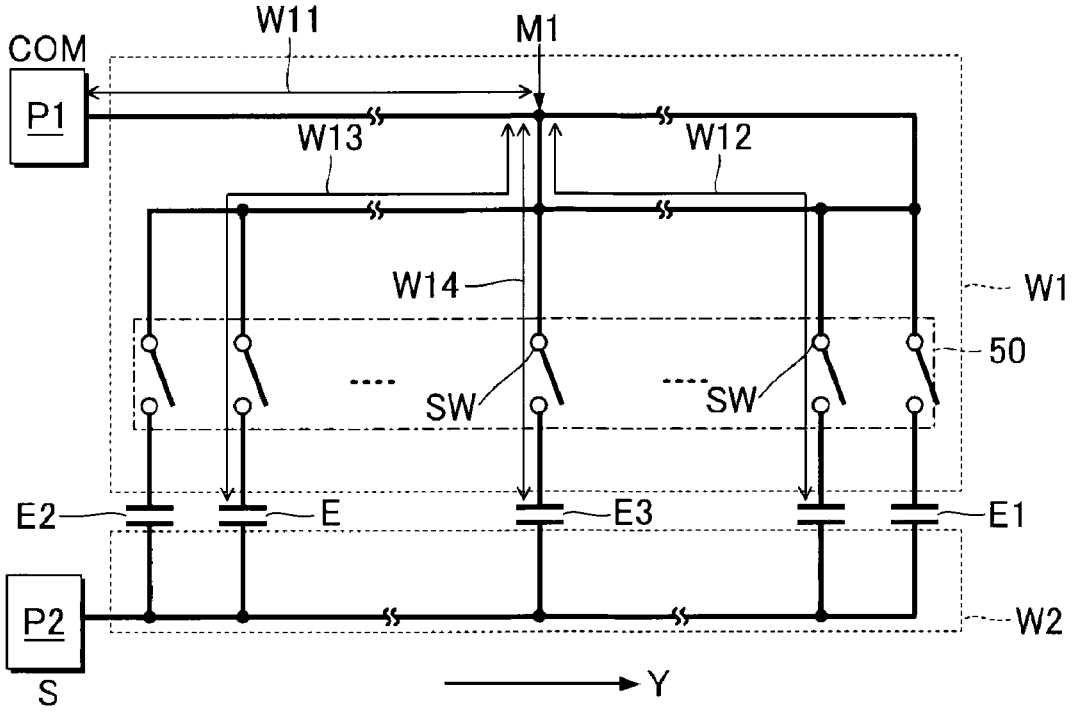
FIG. 6 is a wiring diagram exemplifying a configuration of wiring sections.

FIG. 6 is a wiring diagram exemplifying a configuration of wiring sections W. FIG. 6 illustrates a wiring section W1 for transmitting the driving signal COM and a wiring section W2 for transmitting the hold signal S. The wiring section W1 and the wiring section W2 are formed for each of the arrays U of the energy generation elements E. The driving signal COM is supplied from the control unit 20 to the wiring section W1 through the external wiring 52. Similarly, the hold signal S is supplied from the control unit 20 to the wiring section W2 through the external wiring 52. FIG. 6 illustrates an input section P1 to which the driving signal COM is input from the external wiring 52 and an input section P2 to which the hold signal S is input from the external wiring 52. The input section P1 couples the external wiring 52 to the wiring section W1. The input section P2 couples the external wiring 52 to the wiring section W2.

The wiring section W1 is wiring coupling the input section P1 to the energy generation elements E. Specifically, the wiring section W1 couples the input section P1 to the first electrodes 441. The wiring section W1 is formed across the base 70 and the driving circuit 50. Multiple switches SW corresponding to the energy generation elements E are mounted in the middle of the wiring section W1. Specifically, the wiring section W1 is coupled to the energy generation elements E via the switches SW. The switches SW are formed on the driving circuit 50. Each of the switches SW is composed of a transfer gate for switching between the supply of the driving signal COM to the energy generation elements SW and the stop of the supply of the driving signal COM to the energy generation elements SW. The wiring section W2 is wiring coupling the input section P2 to the second electrode 442 of the energy generation elements E. The wiring section W2 is formed on the base 70.

In the following description, as exemplified in FIGS. 1 and 6, energy generation elements E located at ends of the arrays U are referred to as "energy generation elements E1", energy generation elements E located at the other ends of the arrays U are referred to as "energy generation elements E2", and energy generation elements E located between the energy generation elements E1 and the energy generation elements E2 are referred to as "energy generation elements E3". The energy generation elements E3 according to the first embodiment are energy generation elements E located at central portions of the arrays U.

Each of the energy generation elements E1 is an example of a "first energy generation element" or an example of a "fourth energy generation element". Each of the energy generation elements E2 is an example of a "second energy generation element" or an example of a "fifth energy generation element". Each of the energy generation elements E3 is an example of a "third energy generation element" or an example of a "sixth energy generation element". In addition, each of nozzles N corresponding to the energy generation elements E1 is an example of a "first nozzle" or an example of a "fourth nozzle". Each of nozzles N corresponding to the energy generation elements E2 is an example of a "second nozzle" or an example of a "fifth nozzle". Each of nozzles N corresponding to the energy generation elements E3 is an example of a "third nozzle" or an example of a "sixth nozzle". The second nozzle is a nozzle N among the nozzles N of the arrays U and located closer to the input sections P (P1, P2) than the first nozzle in the Y axis direction. The third nozzle is a nozzle N among the nozzles N of the arrays U and located between the first nozzle and the second nozzle in the Y axis direction. In the first embodiment, each of nozzles N located at first ends of the nozzle strings L is an example of the "first nozzle", and each of nozzles N located at second ends of the nozzle strings L on the opposite side to the first ends is an example of the "second nozzle". As exemplified in FIG. 1, the first nozzle is a nozzle N located at the end on the positive side in the Y axis direction, and the second nozzle is a nozzle N located on the negative side in the Y axis direction. In this case, the input sections P (P1, P2) are located outside the arrays U. Specifically, the input sections P are located on the negative side with respect to the second ends of the arrays U in the Y axis direction. This arrangement is an example. For example, the input sections P may be located at substantially the same positions as the second ends in the Y axis direction. The input section P2 is an example of a "second input section".

As exemplified in FIG. 2, the energy generation elements E2, the energy generation elements E3, and the energy generation elements E1 are arrayed in this order in the Y axis direction in a plan view from the Z axis direction in the liquid ejecting head 26. As exemplified in FIG. 6, the wiring section W1 includes a common wiring path W11, a first individual wiring path W12, a second individual wiring path W13, and a third individual wiring path W14. The common wiring path W11 couples the input section P1 to a branch point M1. The branch point M1 is a point corresponding to the energy generation element E3 on the wiring section W1. The wiring section W1 is branched into two paths at the branch point M1.

The first individual wiring path W12 couples the branch point M1 to multiple energy generation elements E located on the energy generation element E1 side with respect to the energy generation element E3 in the Y axis direction. The second individual wiring path W13 couples the branch point M1 to multiple energy generation elements E located on the energy generation element E2 side with respect to the energy generation element E3 in the Y axis direction. The third individual wiring path W14 couples the branch point M1 to the energy generation element E3. In the first embodiment, it can be said that an energy generation element E that is among the energy generation elements E of the array U and located at a position corresponding to the branch point M1 is the energy generation element E3. Specifically, it can be said that the branch point M1 is located at a central point of a section in which the energy generation elements E are formed in the array U in the wiring section W1. The wiring section W1 may be formed so that the wiring section W1 is branched on any of the first and second surfaces F1 and F2 of the base 70. Alternatively, the wiring section W1 may be formed so that the wiring section W1 is branched from one of the first and second surfaces F1 and F2 of the base 70 toward the other of the first and second surfaces F1 and F2 of the base 70.

Figure 7:
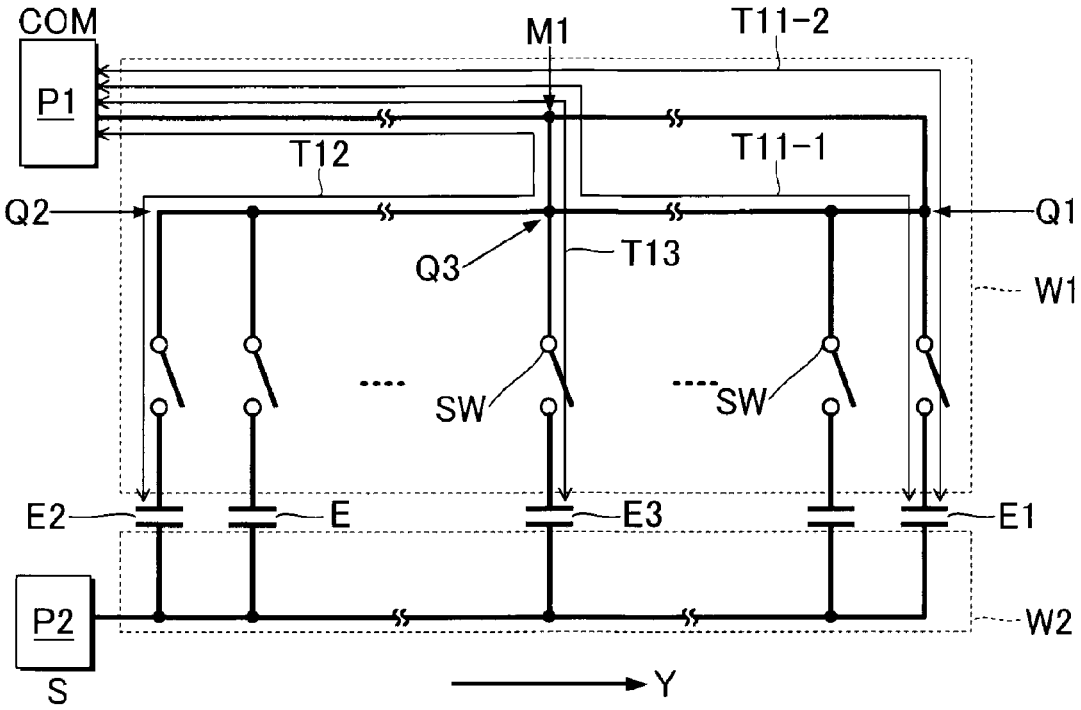
FIG. 7 is a wiring diagram exemplifying the configuration of the wiring sections.

Therefore, as exemplified in FIG. 7, multiple wiring paths (T11-1, T11-2) extending from the input section P1 to the energy generation element E1 exist. In addition, one wiring path (T12) extending from the input section P1 to the energy generation element E2 exists, and one wiring path (T13) extending from the input section P1 to the energy generation element E3 exists. As understood from the above description, the wiring section W1 is branched at the branch point M1 corresponding to the energy generation element E3, and paths after the branch are coupled to the energy generation elements E1 and E2. As exemplified in FIG. 6, it can be said that the wiring section W1 includes annular paths coupled to multiple energy generation elements E that are among the energy generation elements E and located between the energy generation element E1 and the energy generation element E3.

FIG. 7 illustrates lengths of the paths of the wiring section W1. The length of the path T13 between the input section P1 and the energy generation element E3 in the wiring section W1 is shorter than the lengths of the paths T11-1 and T11-2 between the input section P1 and the energy generation element E1 in the wiring section W1 and shorter than the length of the path T12 between the input section P1 and the energy generation element E2 in the wiring section W1.

Figure 8:
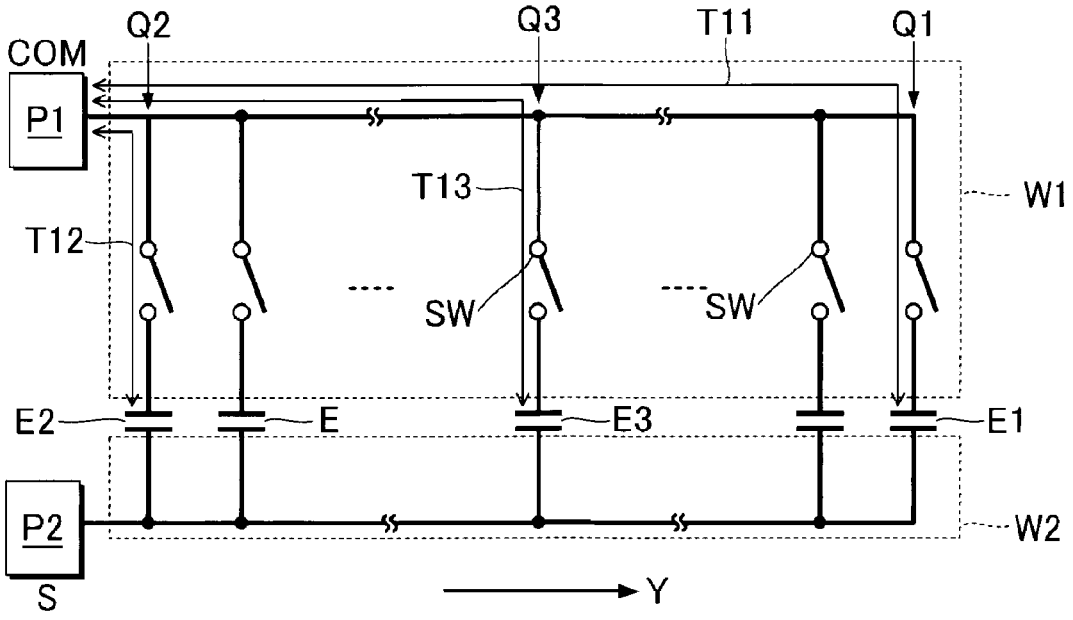
FIG. 8 is a wiring diagram exemplifying a configuration of wiring sections according to a comparative example.

FIG. 8 is a wiring diagram illustrating a configuration (hereinafter referred to as "comparative example") in which a wiring section W1 is not branched. Specifically, in the comparative example, a length of a path T13 between an input section P1 and an energy generation element E3 in the wiring section W1 is shorter than lengths of paths T11-1 and T11-2 between the input section P1 and an energy generation element E1 in the wiring section W1 and longer than a length of a path T12 between the input section P1 and an energy generation element E2 in the wiring section W1.

Figure 9:
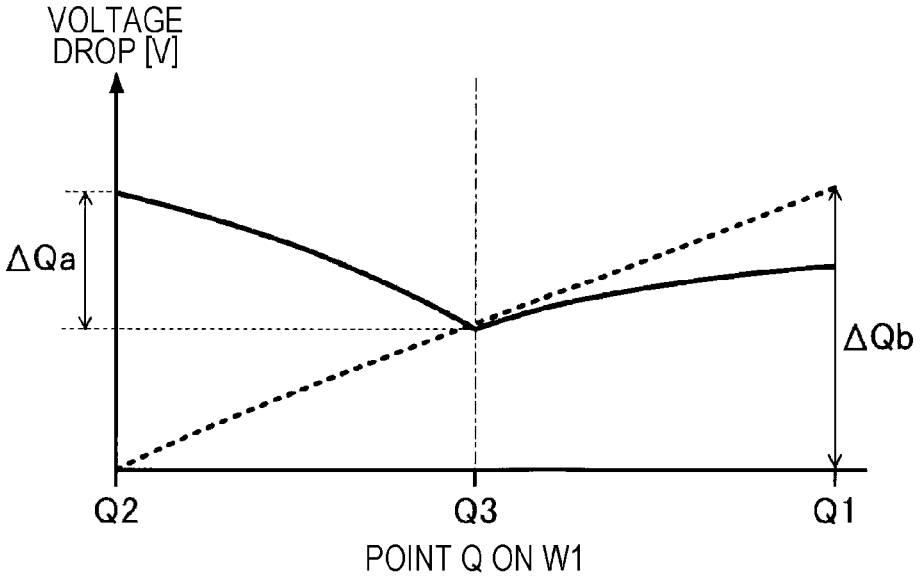
FIG. 9 is a graph illustrating relationships between points on the wiring section and voltage drops at the points.

A voltage drop caused by a resistance component of the wiring section W1 occurs in the wiring section W1. FIG. 9 is a graph indicating relationships between points Q coupled to the energy generation elements E on the wiring section W1 and voltage drops at the points Q in each of the comparative example and the first embodiment. In the following description, lengths of paths extending from the input section P1 through the points Q to the energy generation elements E are also referred to as "lengths of the paths of the points Q" for simplicity.

In FIG. 9, a voltage drop in the comparative example is indicated by a broken line, and a voltage drop in the first embodiment is indicated by a solid line. The left side on the abscissa indicates a point Q located close to the input section P1 on the wiring section W1 and the right side on the abscissa indicates a point Q located far away from the input section P1 on the wiring section W1. On the abscissa of FIG. 9, a point Q1, a point Q2, and a point Q3 are illustrated. As exemplified in FIG. 8, the point Q1 is a point Q coupled to the energy generation element E1 on the wiring section W1, the point Q2 is a point Q coupled to the energy generation element E2 on the wiring section W1, and the point Q3 is a point Q coupled to the energy generation element E3 on the wiring section W1.

As exemplified in FIG. 9, in the comparative example, as a point Q is located farther away from the input section P1 on the wiring section W1, the voltage drop is larger. Specifically, the voltage drop is smallest at the point Q2 and largest at the point Q1 and monotonically increases toward the point Q1 from the point Q2 in a region (including the point Q3) between the points Q2 and Q1.

The reason is presumed as follows. As illustrated in FIG. 8, since the length of the path T12 is the shortest and resistance is small at the point Q2, the voltage drop is small at the point Q2. Since the path length monotonically increases toward the point Q1 from the point Q2, the voltage drop also monotonically increases toward the point Q1 from the point Q2. The length of the path T11 is the longest and the voltage drop is largest at the point Q1.

On the other hand, in the configuration according to the first embodiment, the voltage drop is smallest at the point Q3 and monotonically increases toward the point Q1 from the point Q3. The voltage drop at the point Q2 is larger than the voltage drops at the points Q3 and Q1.

The reason is presumed as follows. As illustrated in FIG. 7, since the length of the path T13 is the shortest and resistance is small at the point Q3, the voltage drop is smallest at the point Q3. However, the length of the path T13 of the point Q3 in the first embodiment is significantly larger than the length of the path T12 of the point Q2 in the comparative example. Therefore, the voltage drop at the point Q3 in the first embodiment is the smallest among voltage drops at the points Q in the first embodiment, but is significantly larger than the voltage drop at the point Q2 in the comparative example.

On the other hand, in the first embodiment, as illustrated in FIG. 7, since the path length monotonically increases toward the point Q2 from the point Q3, the voltage drop monotonically increases toward the point Q2 from the point Q3. Similarly, since the path length monotonically increases toward the point Q3 from the point Q1, the voltage drop monotonically increases toward the point Q3 from the point Q1.

The one wiring path extending from the input section P1 to the energy generation element E2 exists. On the other hand, the multiple wiring paths extending from the input section P1 to the energy generation element E1 exist and combined resistance is small. Therefore, the voltage drop at the point Q2 is larger than the voltage drop at the point Q1.

A difference between voltage drops is described below. The difference between the voltage drops is the difference between the maximum and minimum voltage drops among voltage drops at the points Q coupled to the energy generation elements E on the wiring section W1. The amount ΔQa (voltage drop at the point Q2−voltage drop at the point Q3) of a change in the voltage drop in the first embodiment is smaller than the amount ΔQb (voltage drop at the point Q1−voltage drop at the point Q2) of a change in the voltage drop in the comparative example. A main reason is that the voltage drop at the point Q3 in the first embodiment is larger than the voltage drop at the point Q2 in the comparative example, as described above. Therefore, in the first embodiment, the difference between the voltage drops at the points on the wiring section W1 can be reduced, compared to the comparative example. Accordingly, the voltage of the driving signal COM is uniform between the energy generation elements E. Especially, differences between ejection characteristics of the nozzles N can be reduced. The ejection characteristics are, for example, amounts of ejected ink, ejection directions, or ejection rates.

B. Second Embodiment

A second embodiment of the present disclosure is described. Elements having the same functions as those described in the first embodiment are indicated by the same reference signs as those described in the first embodiment, and detailed descriptions thereof are omitted as appropriate in the following examples.

Figure 10:
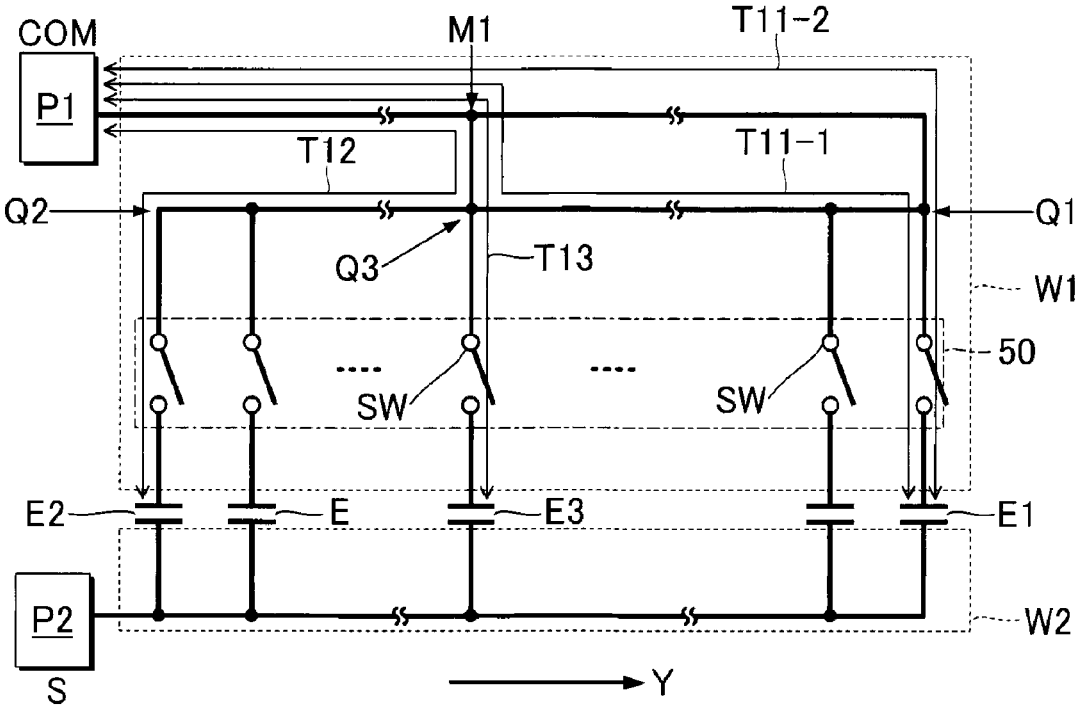
FIG. 10 is a wiring diagram exemplifying a configuration of wiring sections according to a second embodiment of the present disclosure.

FIG. 10 is a wiring diagram of a wiring section W1 and a wiring section W2 according to the second embodiment. In the first embodiment, the branch point M1 is formed at the central point of the section in which the energy generation elements E are formed in the array U in the wiring section W1. On the other hand, in the second embodiment, as exemplified in FIG. 10, a branch point M1 is located closer to the input section P1 than the central point of the section in which the energy generation elements E are formed in the array U in the wiring section W1. Specifically, the branch point M1 exists at the center between the input section P1 and the central point or exists at a ¼ position from the input section P1 side in the section in which the energy generation elements E are formed in the array U in the wiring section W1. Therefore, the energy generation element E3 according to the second embodiment is located closer to the input section P1 than the center of the array U. In the second embodiment, a length of a path T13 is shorter than lengths of paths T11-1 and T11-2 and shorter than a length of a path T12. A liquid ejecting head 26 according to the second embodiment has the same configuration as the liquid ejecting head 26 according to the first embodiment, except that the positions of the branch points M1 in the first and second embodiments are different.

Figure 11:
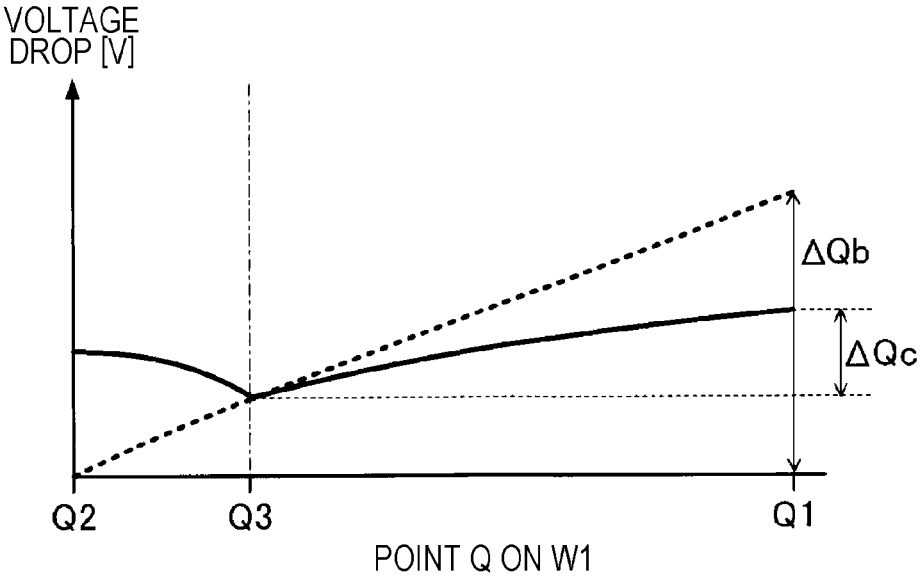
FIG. 11 is a graph illustrating relationships between points on the wiring section and voltage drops at the points.

FIG. 11 is a graph indicating relationships between points Q coupled to the energy generation elements E on the wiring section W1 and voltage drops at the points Q in each of the comparative example and the second embodiment. As exemplified in FIG. 11, the amount ΔQc (voltage drop at a point Q1−voltage drop at a point Q3) of a change in a voltage drop in the second embodiment is smaller than the amount ΔQb (voltage drop at the point Q1−voltage drop at the position Q2) of the change in the voltage drop in the comparative example. In the second embodiment, an effect in which the difference between the voltage drops at the points on the wiring section W1 can be reduced, compared to the comparative example, is achieved, like the first embodiment.

Furthermore, as is apparent from the comparison of FIGS. 11 and 9, in the second embodiment, the voltage drop is entirely small, compared to the first embodiment. The voltage drop is smallest at the point Q3 in the first and second embodiments. However, the voltage drop at the point Q3 in the second embodiment is smaller than the voltage drop at the point Q3 in the first embodiment. This is due to the fact that the length of the path T13 in the second embodiment is shorter than the length of the path T13 in the first embodiment and resistance in the second embodiment is smaller than resistance in the first embodiment.

The voltage drop at the point Q2 in the second embodiment is smaller than the voltage drop at the point Q2 in the first embodiment. This is due to the fact that the length of the path T12 in the second embodiment is shorter than the length of the path T12 in the first embodiment and the resistance in the second embodiment is smaller than the resistance in the first embodiment.

Furthermore, the voltage drop at the point Q3 in the second embodiment is smaller than the voltage drop at the point Q3 in the first embodiment. In the first and second embodiments, the lengths of the paths T11-1 and T11-2 of the point Q3 are the same, differently from the points Q1 and Q2. However, lengths of the paths T11-1 and T11-2 in a region in which the paths T11-1 and T11-2 are arranged side by side or lengths of the paths T11-1 and T11-2 after the branch point M1 in the second embodiment are longer than those in the first embodiment. When multiple wiring paths exist, resistance is small due to the existence of the wiring paths. Although the entire lengths of the paths T11-1 and T11-2 in the second embodiment are equal to the entire lengths of the paths T11-1 and T11-2 in the first embodiment, the region in which the multiple wiring paths exist in the second embodiment is longer than the region in which the multiple wiring paths exist in the first embodiment, and thus resistance in the second embodiment is smaller than resistance in the first embodiment due to the difference between the lengths of the regions. As a result, the voltage drop in the second embodiment is smaller than that in the first embodiment.

The second embodiment has advantages that the difference between the voltage drops at the points on the wiring section W1 is reduced and absolute values of the voltage drops at the points can be small.

C. Third Embodiment

Figure 12:
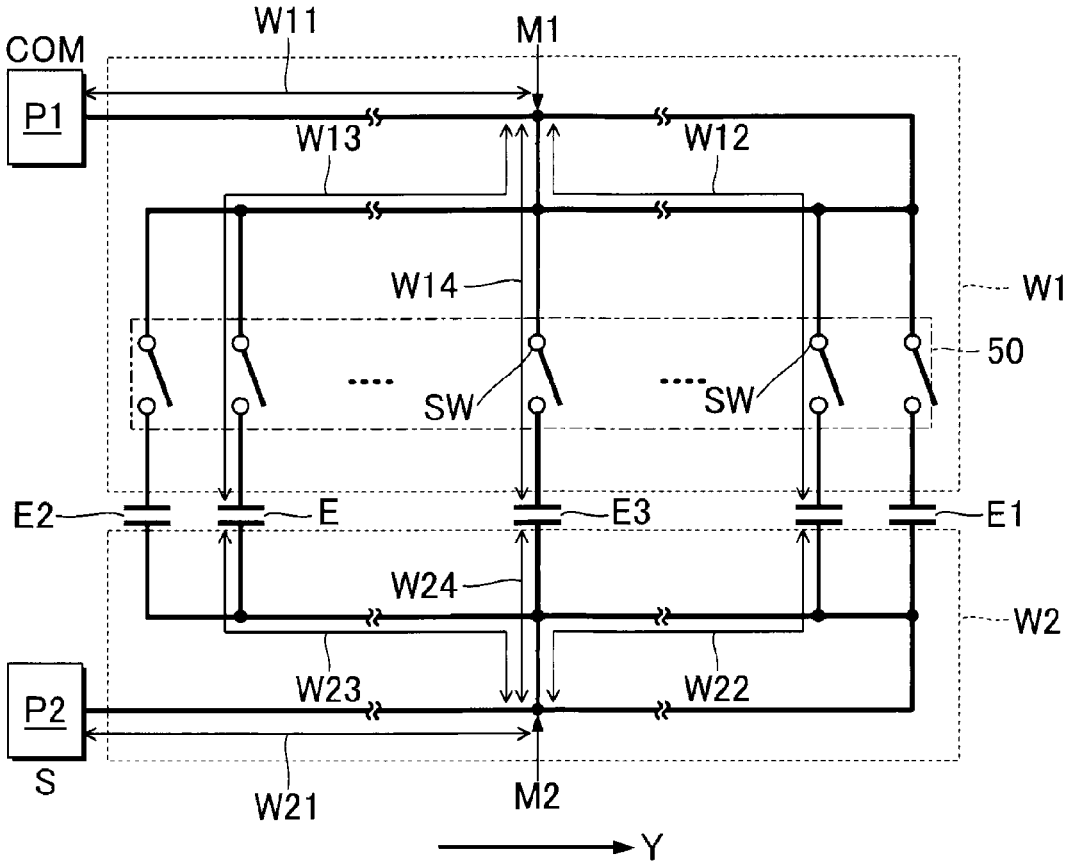
FIG. 12 is a wiring diagram exemplifying a configuration of wiring sections according to a third embodiment of the present disclosure.

FIG. 12 is a wiring diagram of a wiring section W1 and a wiring section W2 according to a third embodiment. As exemplified in FIG. 2, the input section P2, the energy generation elements E2, the energy generation elements E3, and the energy generation elements E1 are arrayed in this order in the Y axis direction in the liquid ejecting head 26. As exemplified in FIG. 12, in the third embodiment, the wiring section W2 has a branch point M2, like the wiring section W1. The branch point M2 is located at a position corresponding to the branch point M1 on the wiring section W2. Specifically, it can be said that the branch point M2 is at a central point of a section in which energy generation elements E are formed in an array U in the wiring section W2.

The wiring section W2 includes a common wiring path W21, a first individual wiring path W22, a second individual wiring path W23, and a third individual wiring path W24. The common wiring path W21 couples a coupling point to the branch point M2. The branch point M2 is a point corresponding to the energy generation element E3 on the wiring section W1. The wiring section W1 is branched into two paths at the branch point M2. The first individual wiring path W22 couples the branch point M2 to multiple energy generation elements E located on the energy generation element E1 side with respect to the energy generation element E3 in the Y axis direction. The second individual wiring path W23 couples the branch point M2 to multiple energy generation elements E located on the energy generation element E2 side with respect to the energy generation element E3 in the Y axis direction. The third individual wiring path W24 couples the branch point M2 to the energy generation element E3.

Therefore, as exemplified in FIG. 12, multiple wiring paths extending from the input section P2 to the energy generation element E1 exist. In addition, one wiring path extending from the input section P2 to the energy generation element E2 exists and one wiring path extending from the input section P2 to the energy generation element E3 exists. As understood from the above description, the wiring section W1 is branched at the branch point M2 corresponding to the energy generation element E3, and the branched paths are coupled to the energy generation elements E2 and E3.

Figure 13:
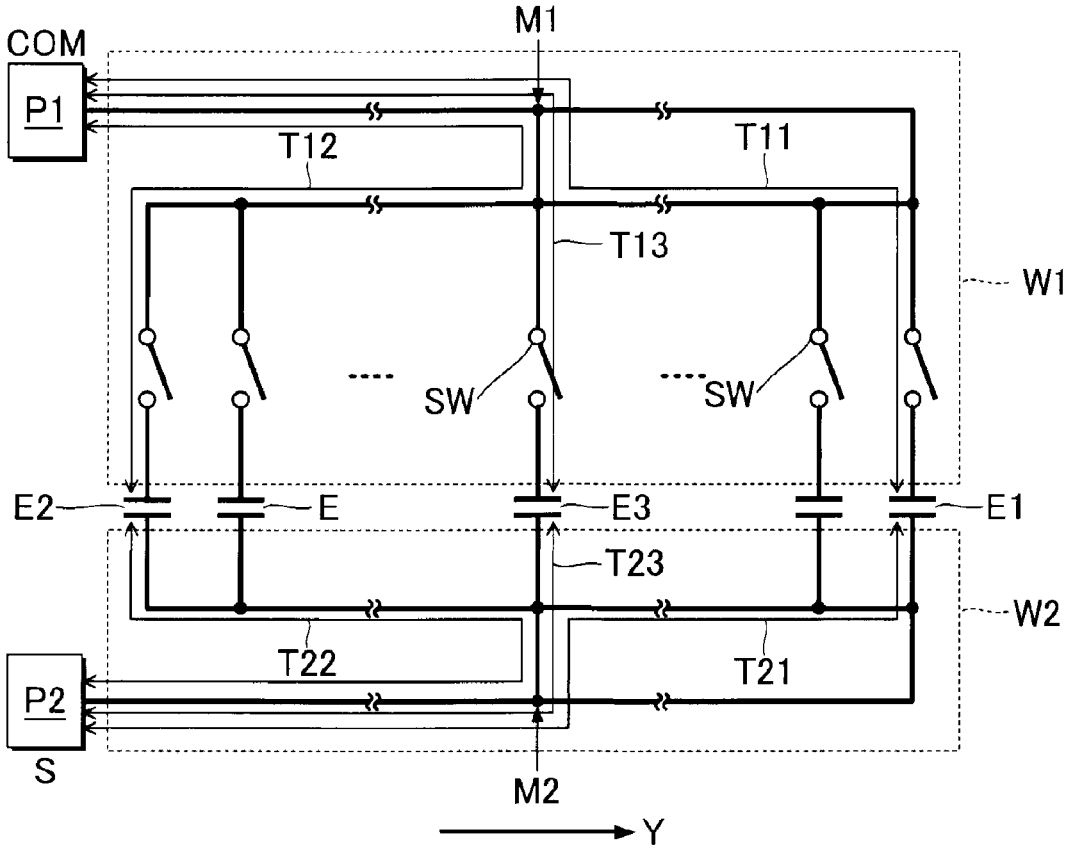
FIG. 13 is a wiring diagram exemplifying the configuration of the wiring sections.

FIG. 13 illustrates lengths of paths of the wiring section W2. A length of a path T23 between the input section P2 and the energy generation element E3 in the wiring section W2 is shorter than a length of a path T21 between the input section P2 and the energy generation element E1 in the wiring section W2 and shorter than a length of a path T22 between the input section P2 and the energy generation element E2 in the wiring section W2.

In the third embodiment, the same effects as those described in the first embodiment are achieved. In the third embodiment, since the branch point M2 is included in the wiring section W2, it is possible to reduce a difference between voltage drops at points on the wiring section W2.

D. Modifications

The embodiments exemplified above may be variously modified. Specific modifications that may be applied in the foregoing embodiments are exemplified below. Two or more aspects arbitrarily selected from the following examples may be appropriately combined without mutual contradiction.

Figure 14:
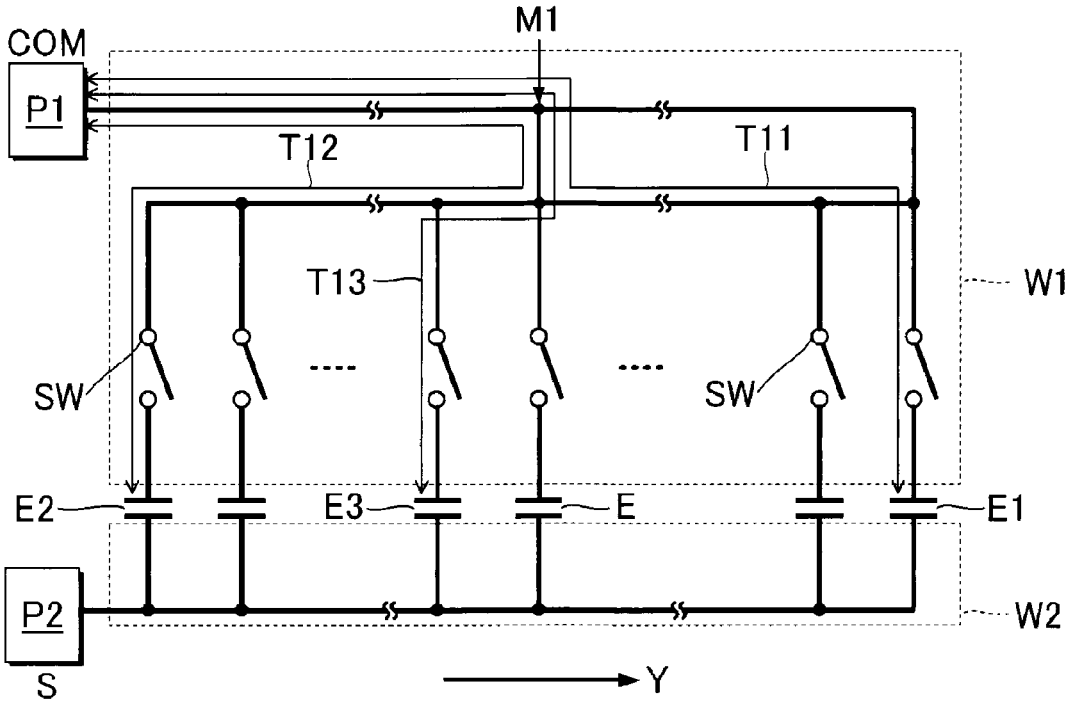
FIG. 14 is a wiring diagram exemplifying a configuration of wiring sections according to a modification.

(1) In each of the foregoing embodiments, the energy generation element E that is among the energy generation elements E and located at the position corresponding to the branch point M1 is exemplified as the energy generation element E3. However, as exemplified in FIG. 14, a piezoelectric element that is among the energy generation elements E and located at a position different from the position corresponding to the branch point M1 may be used as the energy generation element E3. The energy generation element E3 is among the energy generation elements E and is an arbitrary energy generation element E between the energy generation element E1 and the energy generation element E2. In addition, the position of the branch point M1 is arbitrary as long as the branch point M1 is located between the energy generation element E1 and the energy generation element E2 in the section in which the energy generation elements E are formed in the array U in the wiring section W1. As long as the length of the path T13 is shorter than the length of the path T11 and shorter than the length of the path T12, the position of the energy generation element E3 and the position of the branch point M1 are arbitrary. The same applies to the wiring section W2 according to the third embodiment.

(2) In each of the foregoing embodiments, the energy generation element E that is among the energy generation elements E of each of the arrays U and located at the end of each of the arrays U is exemplified as the energy generation element E1, and the energy generation element E that is among the energy generation elements E of each of the arrays U and located at the other end of each of the arrays U is exemplified as the energy generation element E2. However, the energy generation elements E1 and E2 are not limited to the energy generation elements E located at the ends of each of the arrays U. As long as the length of the path T13 is shorter than the length of the path T11 and shorter than the length of the path T12, the positions of the energy generation elements E1 and E2 are arbitrary. The same applies to the wiring section W2 according to the third embodiment. As understood from the above description, the first nozzle corresponding to the energy generation element E1 and the second nozzle corresponding to the energy generation element E2 are not limited to the nozzles N located at both ends of each of the nozzle strings L.

Figure 15:
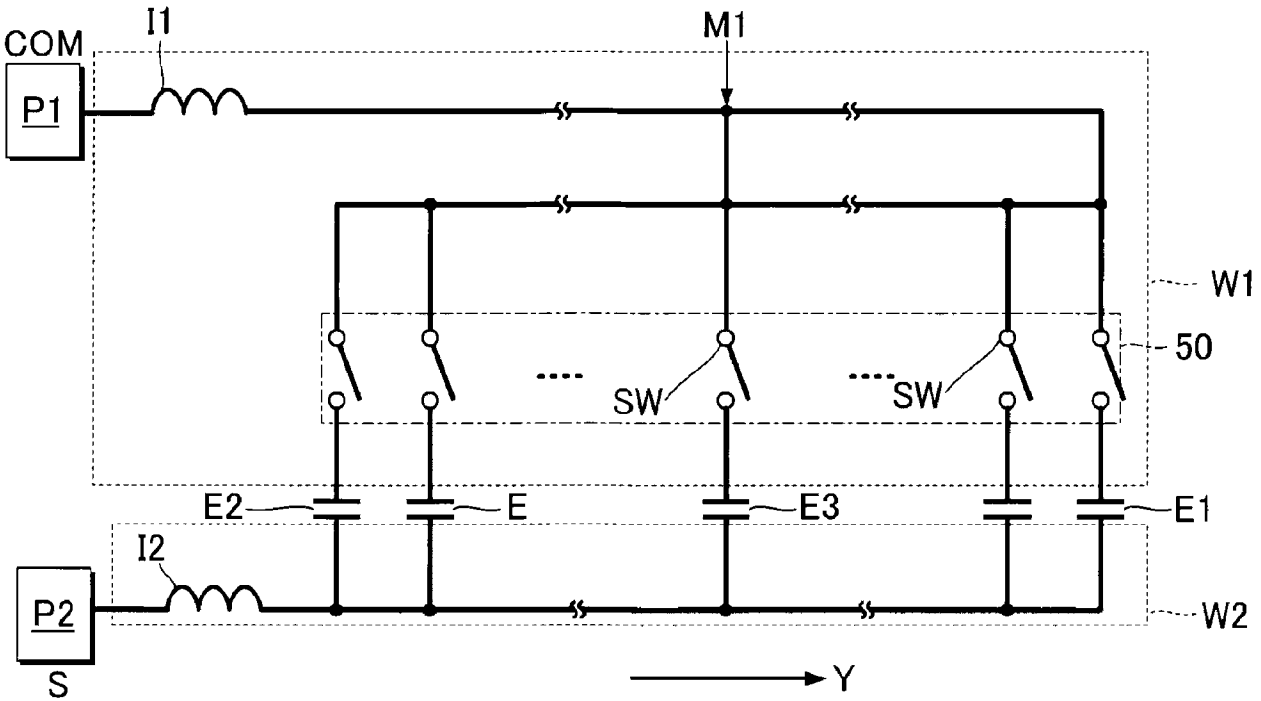
FIG. 15 is a wiring diagram exemplifying a configuration of wiring sections according to a modification.

(3) In each of the foregoing embodiments, as exemplified in FIG. 15, an inductance I1 for correcting a waveform distortion of the driving signal COM may be coupled to the input section P1, and an inductance I2 for correcting a waveform distortion of the hold signal S may be coupled to the input section P2. Specifically, the driving signal COM that has passed through the inductance I1 is supplied to the first electrodes 441 of the energy generation elements E, and the hold signal S that has passed through the inductance I2 is supplied to the second electrode 442 extending across the energy generation elements E. In the foregoing configuration, since waveform distortions of the driving signal COM and the hold signal S are corrected, a target voltage can be applied to the energy generation elements E with high accuracy. Therefore, there is an advantage that the ejection characteristics of the nozzles N can be controlled with high accuracy.

Figure 16:
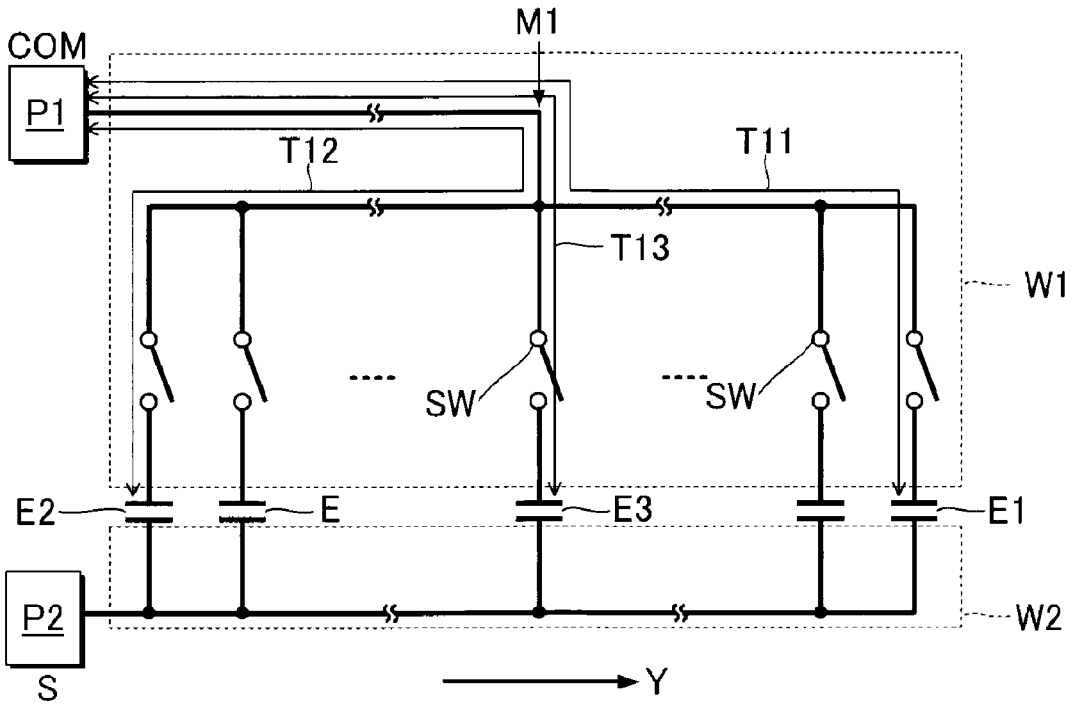
FIG. 16 is a wiring diagram exemplifying a configuration of wiring sections according to a modification.

(4) In each of the foregoing embodiments, the wiring paths extending from the input section P1 to the energy generation element E3 exist. However, as exemplified in FIG. 16, only one wiring path extending from the input section P1 to the energy generation element E3 may exist. Specifically, the wiring section W1 may not have an annular path.

(5) In each of the foregoing embodiments, the input sections P, the energy generation elements E2, the energy generation elements E3, and the energy generation elements E1 are arrayed in this order in the Y axis direction in the liquid ejecting head 26 in the plan view from the Z axis direction. However, positional relationships between the input section P1, the energy generation elements E2, the energy generation elements E3, and the energy generation elements E1 are not limited to the foregoing examples. For example, a configuration in which the input sections P are located between the energy generation elements E2 and the energy generation elements E3 in a plan view may be used.

(6) In each of the foregoing embodiment, the piezoelectric elements for changing the wall surfaces of the pressure chambers C to change the volumes of the pressure chambers C are exemplified as the energy generation elements E. However, heating elements for heating the ink within the pressure chambers C to generate bubbles within the pressure chambers C may be used as the energy generation elements E.

(7) The liquid ejecting apparatus 100 exemplified in each of the foregoing embodiments may be used as not only an apparatus dedicated to printing but also various apparatuses such as a facsimile machine and a copy machine. The liquid ejecting apparatus according to the present disclosure may be used for purposes other than printing. For example, the liquid ejecting apparatus may eject a solution for a color material and may be used as a manufacturing apparatus for manufacturing a color filter of a display device such as a liquid display panel. In addition, the liquid ejecting apparatus may eject a solution for a conductive material and may be used as a manufacturing apparatus for manufacturing wiring of a wiring substrate and an electrode. Furthermore, the liquid ejecting apparatus may eject a solution for an organic object related to a biological object and may be used as a manufacturing apparatus for manufacturing, for example, a biochip.

(8) Each of the foregoing embodiments describes the system in which the two wiring paths extending from the input section P1 to the energy generation element E1 exist in the wiring section W1. Another embodiment may be implemented. For example, three wiring paths extending from the input section P1 to the energy generation element E1 may exist in the wiring section W1. In this case, for example, another branch point may be formed at a ¾ position from the input section P1 in the section in which the energy generation elements E are formed in the array U in the wiring section W1.

Figure 17:
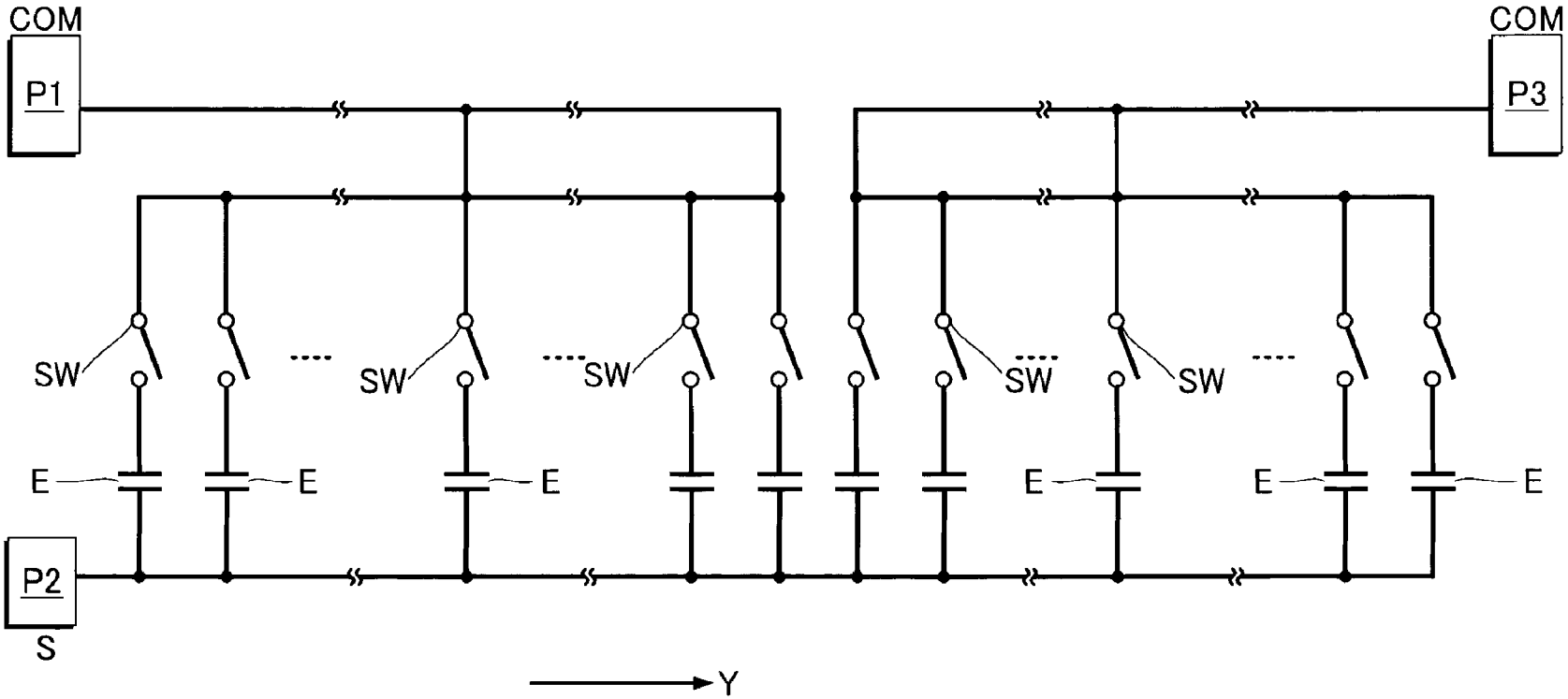
FIG. 17 is a wiring diagram exemplifying a configuration of wiring sections according to a modification.

(9) Each of the foregoing embodiments describes the system in which the input section P1 is located outside the arrays U on the negative side in the Y axis direction. However, another embodiment may be implemented. For example, another input section may be installed outside the arrays U on the positive side in the Y axis direction. In this case, for example, as illustrated in FIG. 17, in a case in which an input section P3 is installed as well as the input section P1, when the arrays U are long and multiple input sections P are to be installed, the same effects as those described in the embodiments can be obtained. For example, the driving signal COM is supplied to the input section P3.

What is claimed is:

1. A liquid ejecting head configured to eject a liquid, comprising:

an input section to which a signal is input;

a nozzle string in which a plurality of nozzles that include a first nozzle, a second nozzle located closer to the input section than the first nozzle, and a third nozzle located between the first nozzle and the second nozzle and eject the liquid are arrayed in a predetermined direction;

a first energy generation element corresponding to the first nozzle;

a second energy generation element corresponding to the second nozzle;

a third energy generation element corresponding to the third nozzle; and a wiring section coupling the input section, the first energy generation element, the second energy generation element, and the third energy generation element, wherein a length of a path between the input section and the third energy generation element in the wiring section is shorter than a length of a path between the input section and the first energy generation element in the wiring section and shorter than a length of a path between the input section and the second energy generation element in the wiring section.

2. The liquid ejecting head according to claim 1, wherein the second nozzle is located on a certain side with respect to the third nozzle in the predetermined direction, the third nozzle is located on the certain side with respect to the first nozzle, and the input section is located on the certain side with respect to the second nozzle.

3. The liquid ejecting head according to claim 1, wherein the first nozzle is located at a first end of the nozzle string, and the second nozzle is located at a second end of the nozzle string on a side opposite to the first end.

4. The liquid ejecting head according to claim 1, wherein a distance between the third nozzle and the second nozzle is shorter than a distance between the third nozzle and the first nozzle.

5. The liquid ejecting head according to claim 1, wherein a plurality of wiring paths extending from the input section to the first energy generation element exist, one wiring path extending from the input section to the second energy generation element exists, and one wiring path extending from the input section to the third energy generation element exists.

6. The liquid ejecting head according to claim 1, wherein the wiring section includes a common wiring path coupling the input section to a branch point, a first individual wiring path coupling the branch point to a plurality of energy generation elements located on a side of the first energy generation element with respect to the third energy generation element in the predetermined direction, a second individual wiring path coupling the branch point to a plurality of energy generation elements located on a side of the second energy generation element with respect to the third energy generation element in the predetermined direction, and a third individual wiring path coupling the branch point to the third energy generation element.

7. The liquid ejecting head according to claim 1, wherein a driving signal to give different amounts of energy to the energy generation elements based on amounts of the liquid to be ejected from the nozzles is input to the input section.

8. The liquid ejecting head according to claim 1, wherein a hold signal to give a constant amount of energy to the energy generation elements regardless of amounts of the liquid to be ejected from the nozzles is input to the input section.

9. The liquid ejecting head according to claim 1, wherein an inductance for correcting a waveform distortion of the signal is coupled to the input section.

10. The liquid ejecting head according to claim 1, further comprising:

a second input section that is different from the input section and to which a signal is input;

a fourth energy generation element corresponding to a fourth nozzle;

a fifth energy generation element corresponding to a fifth nozzle;

a sixth energy generation element corresponding to a sixth nozzle; and a second wiring section coupling the second input section, the fourth energy generation element, the fifth energy generation element, and the sixth energy generation element, wherein the nozzle string includes the fourth nozzle, the fifth nozzle located closer to the second input section than the fourth nozzle, and the sixth nozzle located between the fourth nozzle and the fifth nozzle, and a length of a path between the second input section and the sixth energy generation element in the second wiring section is shorter than a length of a path between the second input section and the fourth energy generation element in the second wiring section and shorter than a length of a path between the second input section and the fifth energy generation element in the second wiring section.

11. A liquid ejecting apparatus comprising:

a liquid ejecting head configured to eject a liquid and including an input section to which a signal is input, a nozzle string in which a plurality of nozzles that include a first nozzle, a second nozzle located closer to the input section than the first nozzle, and a third nozzle located between the first nozzle and the second nozzle and eject the liquid are arrayed in a predetermined direction, a first energy generation element corresponding to the first nozzle, a second energy generation element corresponding to the second nozzle, a third energy generation element corresponding to the third nozzle, and a wiring section coupling the input section, the first energy generation element, the second energy generation element, and the third energy generation element; and a controller that controls the ejection of the liquid, wherein a length of a path between the input section and the third energy generation element in the wiring section is shorter than a length of a path between the input section and the first energy generation element in the wiring section and shorter than a length of a path between the input section and the second energy generation element in the wiring section.

* * * * *